US006890649B2

(12) United States Patent
Hobbs et al.

(10) Patent No.: US 6,890,649 B2
(45) Date of Patent: May 10, 2005

(54) ALIPHATIC POLYESTER MICROFIBERS, MICROFIBRILLATED ARTICLES AND USE THEREOF

(75) Inventors: Terry R. Hobbs, Saint Paul, MN (US); Philip P. Soo, Minneapolis, MN (US); Mario A. Perez, Burnsville, MN (US); Christopher K. Haas, Cottage Grove, MN (US); Robert S. Kody, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 245 days.

(21) Appl. No.: 10/647,525

(22) Filed: Aug. 25, 2003

(65) Prior Publication Data

US 2004/0058140 A1 Mar. 25, 2004

Related U.S. Application Data

(62) Division of application No. 10/132,964, filed on Apr. 26, 2002, now Pat. No. 6,645,618.

(51) Int. Cl.[7] ..... D01F 6/00

(52) U.S. Cl. ..... 428/365; 428/359; 428/362; 428/397; 428/399

(58) Field of Search ..... 428/359, 362, 428/397, 399, 365; 264/291, 292, 147

(56) References Cited

U.S. PATENT DOCUMENTS

| | | |
|---|---|---|
| 3,565,985 A | 2/1971 | Schrenk et al. |
| 3,636,956 A | 1/1972 | Schneider |

(Continued)

FOREIGN PATENT DOCUMENTS

| | | |
|---|---|---|
| EP | 1 091 028 A1 | 4/2001 |
| WO | WO 84/04311 | 11/1984 |
| WO | WO 94/07949 | 4/1994 |
| WO | WO 95/23250 | 8/1995 |
| WO | WO 96/22330 | 7/1996 |
| WO | WO 98/24951 | 6/1998 |
| WO | WO 98/50611 | 11/1998 |
| WO | WO 99/06456 | 2/1999 |
| WO | WO 99/50345 | 10/1999 |
| WO | WO 00/12606 | 3/2000 |
| WO | WO 00/46435 | 8/2000 |
| WO | WO 00/68301 | 11/2000 |

OTHER PUBLICATIONS

H. R. Kricheldorf, "Syntheses and Application fo Polylactides", Chemosphere 43, pp. 49–54, (2001).

(Continued)

*Primary Examiner*—N. Edwards
(74) *Attorney, Agent, or Firm*—Kent S. Kokko

(57) ABSTRACT

The present invention relates to aliphatic polyester microfibers, films having a microfibrillated surface, and methods of making the same. Microfibers of the invention can be prepared by imparting fluid energy, typically in the form of high-pressure water jets, to a highly oriented, highly crystalline, aliphatic polyester film to liberate microfibers therefrom. Microfibrillated films of the invention find use as tape backings, filters for particulate contaminants, such as face masks and water or air filters, fibrous mats, such as those used for removal of oil from water and those used as wipes, and thermal and acoustical insulation. Microfibers of the invention, when removed from the film matrix may be used in the preparation of woven or nonwoven articles and used as wipes for the removal of debris or dust from a surface. The microfibers and microfibrillated articles of the invention may be biodegradable, rendering them useful for geotextiles.

25 Claims, 2 Drawing Sheets

10μm

U.S. PATENT DOCUMENTS

Figure 1:
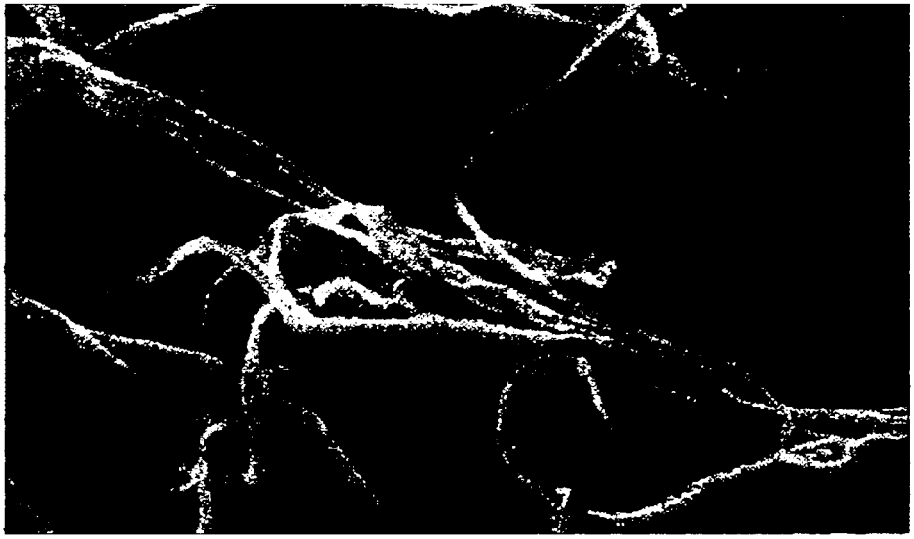

| | | | | |
|---|---|---|---|---|
| 4,330,499 | A | 5/1982 | von und zu Aufsess et al. | |
| 4,595,738 | A | 6/1986 | Hufnagel et al. | |
| 4,675,582 | A | 6/1987 | Hommes et al. | |
| 4,744,365 | A | 5/1988 | Kaplan et al. | |
| 4,825,111 | A | 4/1989 | Hommes et al. | |
| 4,853,602 | A | 8/1989 | Hommes et al. | |
| 5,036,262 | A | 7/1991 | Schonbach | |
| 5,051,225 | A | 9/1991 | Hommes et al. | |
| 5,072,493 | A | 12/1991 | Hommes et al. | |
| 5,389,324 | A | 2/1995 | Lewis et al. | |
| 5,427,842 | A | 6/1995 | Bland et al. | |
| 5,475,063 | A | 12/1995 | Kaplan et al. | |
| 5,589,122 | A | 12/1996 | Leonard et al. | |
| 5,599,602 | A | 2/1997 | Leonard et al. | |
| 5,633,343 | A | 5/1997 | Bezwada et al. | |
| 5,660,922 | A | 8/1997 | Herridge et al. | |
| 5,798,436 | A | 8/1998 | Gruber et al. | |
| 5,883,199 | A | 3/1999 | McCarthy et al. | |
| 5,952,433 | A | 9/1999 | Wang et al. | |
| 5,997,568 | A | 12/1999 | Liu | |
| 5,998,549 | A | 12/1999 | Milbourn et al. | |
| 6,075,118 | A | 6/2000 | Wang et al. | |
| 6,093,792 | A | 7/2000 | Gross et al. | |
| 6,110,588 | A | 8/2000 | Perez et al. | |
| 6,111,060 | A | 8/2000 | Gruber et al. | |
| 6,117,928 | A | 9/2000 | Hiltunen et al. | |
| 6,143,863 | A | 11/2000 | Gruber et al. | |
| 6,331,343 | B1 | 12/2001 | Perez et al. | |
| 6,420,024 | B1 * | 7/2002 | Perez et al. | 428/359 |
| 6,432,532 | B2 * | 8/2002 | Perez et al. | 428/359 |
| 6,586,073 | B2 | 7/2003 | Perez et al. | |
| 6,630,231 | B2 | 10/2003 | Perez et al. | |
| 6,645,618 | B2 * | 11/2003 | Hobbs et al. | 428/359 |

OTHER PUBLICATIONS

J. W. Leenslag et al., "Resorbable Materials of Poly(L–lactide), V. Influence of Secondary Structure on the Mechanical Properties and Hydrolyzability of Poly(L–lactide) Fibers Produced by a Dry–Spinning Method", Journal of Applied Polymer Science, vol. 29, pp. 2829–2842, (1984).

R. S. Porter et al., "Uniaxial Extension and Order Development in Flexible Chain Polymers", Journal of Macromolecular Science–Rev. Macromol. Chem. Phys., C35(a), pp. 63–115, (1995).

H. Tsuji et al., "Stereocomplex Formation Between Enantiomeric Poly(lactics acids)s. XI. Mechanical Properties and Morphology of Solution–Cast Films", Polymer 40, pp. 6699–6708, (1999).

Encyclopedia of Polymer Science and Engineering, Anionic Polymerization to Cationic Polymerization, vol. 2, pp. 230–232, (1985), John Wiley & Sons.

McGraw–Hill Encyclopedia of Science & Technology, 6$^{th}$ Edition, pp. 69–71, (1987).

Encyclopedia of Chemical Technology, Fuel Resources to Heat Stabilizers, vol. 12, 4$^{th}$ Edition, pp. 503–511, John Wiley & Sons.

H. Steuer, "Biohybride Nerve Guide for Regeneration: Degradable Polyactide Fibers Coated With Rat Schwann Cells", Neuroscience Letters 277, ppl 165–168, (1999).

J. Lunt, Ph. D., "Polyactic Acid Polymers from Corn Potential Applications in the Textiles Industry", Cargill Dow Polymers LLC, Minnetonka, MN.

P. Eiselt et al., "Development of Technologies Aiding Large–Tissue Engineering", Biotechnology Progress, vol. 14, Issue 1, pp. 134–140, (1998).

* cited by examiner

10μm

100μm

10μm

10μm

ALIPHATIC POLYESTER MICROFIBERS, MICROFIBRILLATED ARTICLES AND USE THEREOF

This application is a divisional of application Ser. No. 10/132,964 filed Apr. 26, 2002 now U.S. Pat. No. 6,645,618 (Hobbs, et al.) the disclosure of which is herein incorporated by reference.

FIELD OF THE INVENTION

The present invention relates to aliphatic polyester microfibers, films having a microfibrillated surface, and methods of making the same. Microfibers of the invention can be prepared by imparting fluid energy, typically in the form of high-pressure water jets, to a highly oriented, semicrystalline, aliphatic polyester film to liberate microfibers therefrom. Microfibrillated articles of the invention find use as tape backings, filtration media, such as face masks and water or air filters, fibrous mats, such as those used for removal of oil from water and those used as wipes, and thermal and acoustical insulation. Microfibers of the invention, when removed from the film matrix may be used in the preparation of woven or nonwoven articles and used as wipes for the removal of debris or dust from a surface. The microfibers and microfibrillated articles of the invention may be biodegradable and/or bioabsorbable, rendering them useful for wound dressings, disposable products, and geotextiles.

BACKGROUND OF THE INVENTION

Polymeric fibers have been known essentially since the beginnings of commercial polymer development. The production of polymer fibers from polymer films is also well known. Typically, molten polymer is extruded through a die or small orifice in a continuous manner to form a continuous thread. The fiber can be further drawn to create an oriented filament with significant tensile strength. Fibers created by a traditional melt spinning process are generally larger than 15 microns. Smaller fiber sizes are impractical because of high melt viscosity of the molten polymer. Fibers with a diameter less than 15 microns can be created by a melt blowing process. However, the resins used in this process are low molecular weight and viscosity rendering the resulting fibers very weak. In addition, a post spinning process such as length orientation cannot be used.

Orientation of crystalline polymeric films and fibers has been accomplished in numerous ways, including hot drawing, melt spinning, melt transformation (co)extrusion, solid state coextrusion, gel drawing, solid state rolling, die drawing, solid state drawing, and roll-trusion, among others. Each of these methods has been successful in preparing oriented, high modulus polymer fibers and films. Most solid-state processing methods have been limited to slow production rates, on the order of a few cm/min. Methods involving gel drawing can be fast, but require additional solvent-handling steps. A combination of rolling and drawing solid polymer sheets, particularly polyolefin sheets, has been described in which a polymer billet is deformed biaxially in a two-roll calender then additionally drawn in length (i.e., the machine direction). Methods that relate to other web handling equipment have been used to achieve molecular orientation, including an initial nip or calender step followed by stretching in both the machine direction or transversely to the film length.

The production of macroscopic fibers from films has been established. Liberating fibers from oriented, high-modulus polymer films, particularly from high molecular weight semicrystalline films, has been accomplished in numerous ways, including abrasion, mechanical plucking by rapidly-rotating wire wheels, and impinging water jets to slit the film. Water jets have been used extensively to cut films into flat, wide continuous longitudinal fibers for strapping or reinforcing uses.

Pennings et. al. in "Mechanical properties and hydrolyzability of Poly(L-lactide) Fibers Produced by a Dry-Spinning Method", J. Appl. Polym. Sci., 29, 2829–2842 (1984) described fibers with a fibrillar structure by solution spinning using chloroform in the presence of various additives (camphor, polyurethanes) followed by hot drawing. These fibers showed good mechanical properties and improved degradability in vitro with the fibrillar structure speeding up the hydrolysis of the fiber. The inherent disadvantage of this process is the use of chlorinated solvents in the spinning process.

Microfibers with a diameter of 1 micrometer and a round cross section have also been produced by electrospinning. The electrospinning technique also suffers from the disadvantage of using a chlorinated solvent and has low production speeds.

WO 95/23250 discloses a process for preparing biodegradable fibrils from polylactide where a polymer solution is precipitated into a non-solvent. The fibrils can be dried and formed into a biodegradable nonwoven article.

U.S. Pat. No. 6,111,060 (Gruber et al.) discloses the use of melt stable polylactides to form nonwoven articles via melt blown and spunbound processes. These fibers have low orientation and have generally low tensile strength. In addition, the fibers have a round cross sectional area comparable to traditional textile fibers.

WO 9824951 discloses the production of multicomponent fibers for nonwovens comprising two different polylactides.

SUMMARY OF THE INVENTION

The present invention is directed to aliphatic polyester microfibers having an average effective diameter less than 20 microns, generally from 0.01 microns to 10 microns, and substantially rectangular in cross section, having a transverse aspect ratio (width to thickness) of from 1.5:1 to 20:1, and generally about 3:1 to 9:1. Since the microfibers are substantially rectangular, the effective diameter is a measure of the average value of the width and thickness of the microfibers. The cross-sectional area of the fibers is generally from about 0.05 to $3.0\mu^2$, and typically 0.1 to $2.0\mu^2$.

The rectangular cross-sectional shape advantageously provides a greater surface area (relative to fibers of the same diameter having round or square cross-section) making the microfibers (and microfibrillated films) especially useful in applications such as filtration and as reinforcing fibers in cast materials. The surface area is generally greater than about 0.25 $m^2$/gram, typically about 0.5 to 30 $m^2$/g. Further, due to their biodegradability and/or bioabsorbability, the microfibers of the present invention are useful in applications such as geotextiles , as suture materials and as wound dressings for skin surfaces.

The present invention is further directed toward the preparation of microfibrillated articles, i.e. highly-oriented films having a microfibrillated surface, by the steps of providing a highly oriented, voided or microvoided, aliphatic polyester film, and microfibrillating said voided film by imparting sufficient fluid energy thereto. The fluid energy may be imparted by a high pressure fluid jet or by ultrasonic agitation. As used herein, the term "microfibrillated article"

refers to an article, such as a film or sheet bearing a microfibrillated surface comprising microfibers prepared from oriented films. Optionally the microfibers may be harvested from the microfibrillated surface of the film.

The voided film may be an aliphatic polyester microvoided film, or a voided film prepared from an immiscible mixture of an aliphatic polyester and a void-initiating particle. As used herein, the term "film" shall also encompass sheets, including foamed sheets and it may also be understood that other configurations and profiles such as tubes may be provided with a microfibrillated surface with equal facility using the process of this invention. As used herein, the term "voided" shall also include "microvoided".

Advantageously the process of the invention is capable of high rates of production, is suitable as an industrial process and uses readily available polymers. The microfibers and microfibrillated articles of this invention, having extremely small fiber diameter and both high strength and modulus, are useful as tape backings, strapping materials, films with unique optical properties and high surface area, low density reinforcements for thermosets, impact modifiers or crack propagation prevention in matrices such as concrete, and as fibrillar forms (dental floss or nonwovens, for example). The microfibers and microfibrillated articles may be used in applications where biodegradability and or bio-absorbability are desirable. Such applications include, bandages, and wound dressings, packaging materials such as bags, tape Or cartons, personal hygiene products, and geotextiles, such as those used for stabilization, protection or drainage of soils.

The process of the invention produces a fiber having a high degree of uniaxial orientation resulting in high strength, modulus, and toughness compared to prior art processes for producing microfibers. Furthermore, the process does include the use of solvents that are costly and possibly harmful. The fibers also have a unique cross sectional aspect ratio>1.5 and an effective diameter of less than ten micrometers, generally less than 5 micrometers.

As used herein, "biodegradable" is meant to represent that the microfibers or microfibrillated articles degrade from the action of naturally occurring microorganisms such as bacteria, fungi and algae and/or natural environmental factors.

As used herein "bioabsorbable" means that the microfibers or microfibrillated articles may be broken down by biochemical and/or hydrolytic processes and absorbed by living tissue.

BRIEF DESCRIPTION OF THE FIGS.

Figure 2:
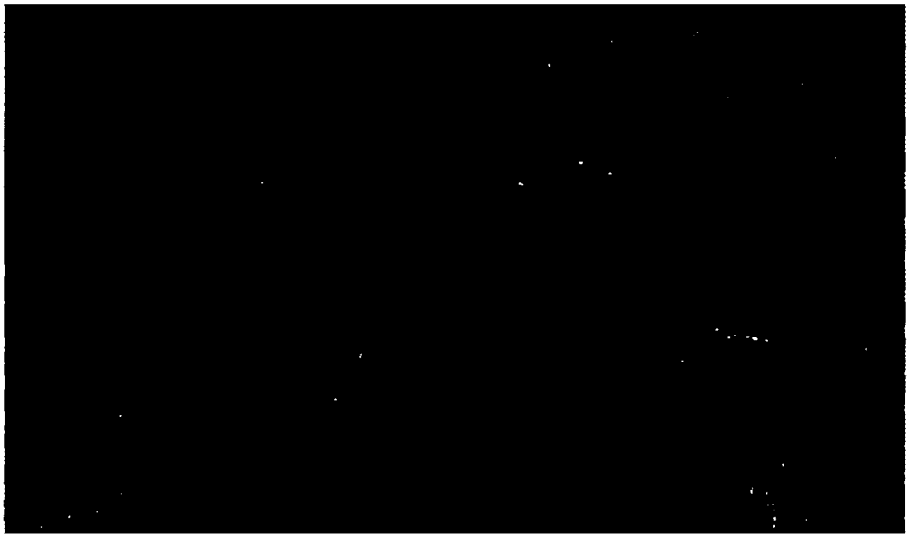
Figure 3:
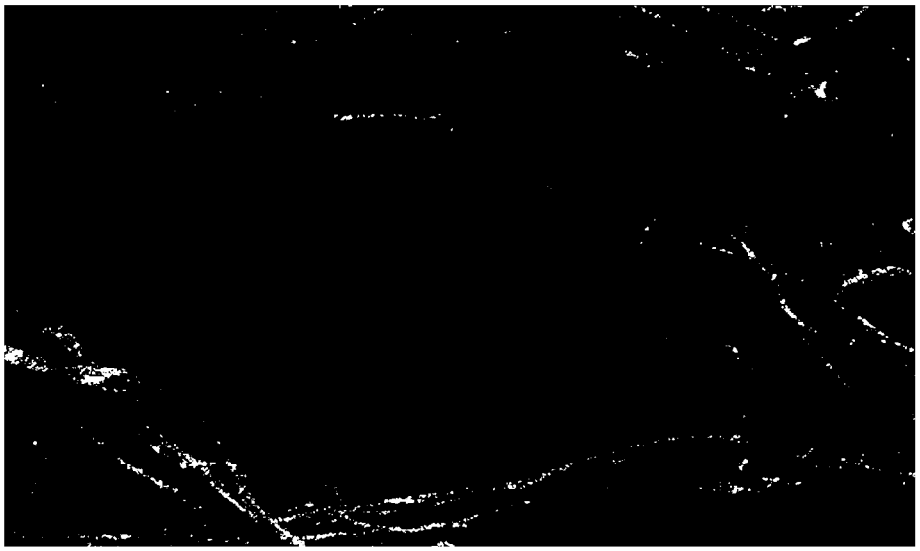
Figure 4:
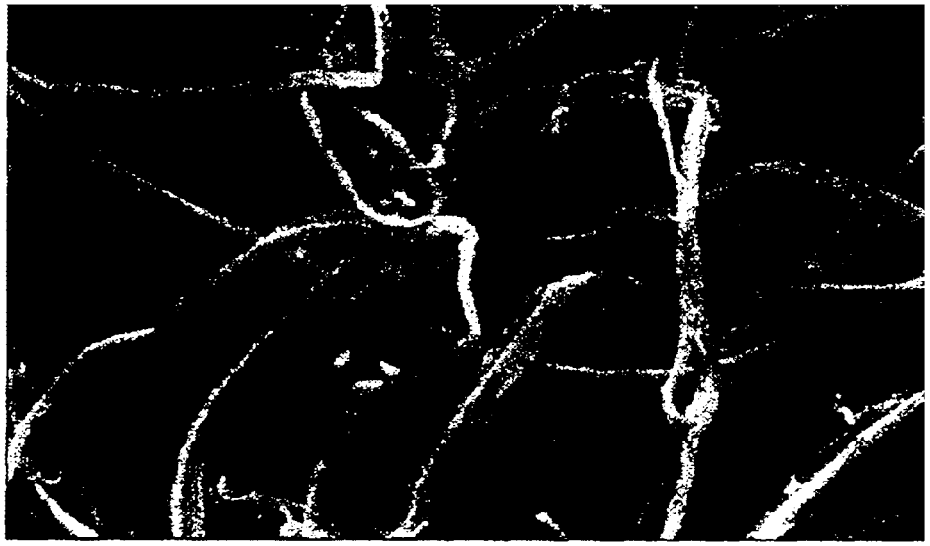

FIGS. 1 to 4 are a digital images of scanning electron micrographs of the microfibrillated articles of the invention.

DETAILED DESCRIPTION

Aliphatic polyesters useful in the present invention include homo- and copolymers of poly(hydroxyalkanoates) and homo- and copolymers of those aliphatic polyesters derived from the reaction product of one or more alkanediols with one or more alkanedicarboxylic acids (or acyl derivatives). Miscible and immiscible blends of aliphatic polyesters with one or more additional semicrystalline or amorphous polymers may also be used.

One useful class of aliphatic polyesters are poly (hydroxyalkanoates), derived by condensation or ring-opening polymerization of hydroxy acids, or derivatives thereof. Suitable poly(hydroxyalkanoates) may be represented by the formula $H(O—R—C(O)—)_nOH$, where R is an alkylene moiety that may be linear or branched and n is a number from 1 to 20, preferably 1 to 12. R may further comprise one or more caternary (i.e. in chain) ether oxygen atoms. Generally the R group of the hydroxyl acid is such that the pendant hydroxyl group is a primary or secondary hydroxyl group.

Useful poly(hydroxyalkanoates) include, for example, homo- and copolymers of poly(3-hydroxybutyrate), poly(4-hydroxybutyrate), poly(3-hydroxyvalerate), poly(lactic acid) (as known as polylactide), poly(3-hydroxypropanoate), poly(4-hydropcntanoate), poly(3-hydroxypentanoate), poly(3-hydroxyhexanoate), poly(3-hydroxyheptanoate), poly(3-hydroxyoctanoate), polydioxanone, and polycaprolactone, polyglycolic acid (also known as polyglycolide). Copolymers of two or more of the above hydroxy acids may also be used, for example, poly(3-hydroxybutyrate-co-3-hydroxyvalerate), poly (lactate-co-3-hydroxypropanoate) and poly(glycolide-co-p-dioxanone). Blends of two or more of the poly (hydroxyalkanoates) may also be used, as well as blends with one or more semicrystalline or amorphous polymer.

Another useful class of aliphatic polyesters includes those aliphatic polyesters derived from the reaction product of one or more alkanediols with one or more alkanedicarboxylic acids (or acyl derivatives). Such polyesters have the general formula $$HO(\overset{O}{\overset{\|}{C}}R''\overset{O}{\overset{\|}{C}})_n—[OR'O—\overset{O}{\overset{\|}{C}}—R''—\overset{O}{\overset{\|}{C}}—O]_m—(R^1O)_nH$$

where R' and R" each represent an alkylene moiety that may be linear or branched having from 1 to 20, preferably 1 to 12 carbon atoms, and m is a number such that the ester is polymeric, and is preferably a number such that the molecular weight of the aliphatic polyester is 10,000 to 300,000 and is preferably from about 30,000 to 200,000. Each n is independently 0 or 1. R' and R" may further comprise one or more caternary (i.e. in chain) ether oxygen atoms.

Examples of aliphatic polyesters include those homo-and copolymers derived from (a) one or more of the following diacids (or derivative thereof): succinic acid, adipic acid, 1,12 dicarboxydodecane, fumaric acid, and maleic acid and (b) one of more of the following diols: ethylene glycol, polyethylene glycol, 1,2-propane diol, 1,3-propanediol, 1,2-propanediol, 1,2-butanediol, 1,3-butanediol, 1,4-butanediol, 1,6-hexanediol, diethylene glycol, and polypropylene glycol, and (c) optionally a small amount, i.e. 0.5–7.0 mole % of a polyol with a functionality greater than two such as glycerol, neopentyl glycol, and pentaerythritol.

Such polymers may include polybutylenesuccinate homopolymer, polybutylene adipate homopolmer, polybutyleneadipate-succinate copolymer, polyethylenesuccinate-adipate copolymer, polyethylene adipate homopolymer.

Commercially available aliphatic polyesters include include polylactide, polyglycolide, polylactide-co-glycolide, poly(L-lactide-co-trimethylene carbonate), poly (dioxanone), poly(butylene succinate), and poly(butylene adipate).

Especially useful aliphatic polyesters include those derived from semicrystalline polylactic acid. Polylactic acid (or polylactides) has lactic acid as its principle degradation product, which is commonly found in nature, is non-toxic and is widely used in the food, pharmaceutical and medical industries. The polymer may be prepared by ring-opening polymerization of the lactic acid dimer, lactide. Lactic acid is optically active and the dimer appears in four different forms: L,L-lactide, D,D-lactide, D,L-lactide (meso lactide) and a racemic mixture of L,L- and D,D-. By polymerizing these lactides as pure compounds or as blends, polylactide polmers may be obtained having different stereochemistries and different physical properties, including crystallinity. The LL- or D,D-lactide yields semicrystalline polylactide and are preferred, while the polylactide derived from the D,L-lactide is amorphous.

The polylactide preferably has a high enantiomeric ratio to maximize the intrinsic crystallinity of the polymer. The degree of crystallinity of a poly(lactic acid) is based on the regularity of the polymer backbone and the ability to line crystallize with other polymer chains. If relatively small amounts one enantiomer (such as D-) is copolymerized with the opposite enantiomer (such as L-) the polymer chain becomes irregularly shaped, and becomes less crystalline. For these reasons it is desirable to have a poly(lactic acid) that is at least 85% of one isomer, preferably at least 90%, and most preferably at least 95% in order to maximize the crystallinity.

An approximately equimolar blend of D-polylactide and L-polylactide is also useful in the present invention. This blend forms a unique crystal structure having a higher melting point (~210° C.) than does either the D-polylactide and L-polylactide alone (~190° C.), and has improved thermal stability. Reference may be made to H. Tsuji et. al., Polymer 40 (1999) 6699–6708.

Copolymers, including block and random copolymers, of poly(lactic acid) with other aliphatic polyesters may also be used. Useful co-monomers include glycolide, beta-propiolactone, tetramethyglycolide, beta-butyrolactone, gamma-butyrolactone, pivalolactone, 2-hydroxybutyric acid, alpha-hydroxyisobutyric acid, alpha-hydroxyvaleric acid, alpha-hydroxyisovaleric acid, alpha-hydroxycaproic acid, alpha-hydroxyethylbutyric acid, alpha-hydroxyisocaproic acid, alpha-hydroxy-beta-methylvaleric acid, alpha-hydroxyoctanoic acid, alpha-hydroxydecanoic acid, alpha-hydroxymyristic acid, and alpha-hydroxystearic acid.

Blends of poly(lactic acid) and one or more other aliphatic polyesters, or one or more other polymers may also be used in the present invention. Examples of useful blends include poly(lactic acid) and poly(vinyl alcohol), polyethylene glycol/polysuccinate, polyethylene oxide, polycaprolactone and polyglycolide.

In blends of aliphatic polyesters with a second amorphous or semicrystalline polymer, if the second polymer is present in relatively small amounts, the second polymer will generally form a discreet phase dispersed within the continuous phase of the aliphatic polyester. As the amount of the second polymer in the blend is increased, a composition range will be reached at which the second polymer can no longer be easily identified as the dispersed, or discrete phase. Further increase in the amount of second polymer in the blend will result in two co-continuous phases, then in a phase inversion wherein the second polymer becomes the continuous phase. Preferably, the aliphatic polyester component forms the continuous phase while the second component forms a discontinuous, or discrete, phase dispersed within the continuous phase of the first polymer, or both polymers form co-continuous phases. Where the second polymer is present in amounts sufficient to form a co-continuous phase, subsequent orientation and microfibrillation may result in a composite article comprising microfibers of both polymers.

Useful polylactides may be prepared as described in U.S. Pat. No. 6,111,060 (Gruber, et al.), U.S. Pat. No. 5,997,568 (Liu), U.S. Pat. No. 4,744,365 (Kaplan et al.), U.S. Pat. No. 5,475,063 (Kaplan et al.), WO 98/24951 (Tsai et al.), WO 00/12606 (Tsai et al.), WO 84/04311 (Lin), U.S. Pat. No. 6,117,928 (Hiltunen et al.), U.S. Pat. No. 5,883,199 (McCarthy et al.), WO 99/50345 (Kolstad et al.), WO 99/06456 (Wang et al.), WO 94/07949 (Gruber et al.), WO 96/22330 (Randall et al.), WO 98/50611 (Ryan et al.), U.S. Pat. No. 6143863 (Gruber et al.), U.S. Pat. No. 6,093,792 (Gross et al.), U.S. Pat. No. 6,075,118 (Wang et al.), and U.S. Pat. No. 5,952,433 (Wang et al.), the disclosure of each U.S. patent incorporated herein by reference. Reference may also be made to J. W. Leenslag, et al., J. Appl. Polymer Science, vol. 29 (1984), pp 2829–2842, and H. R. Kricheldorf, Chemosphere, vol. 43, (2001) 49–54.

The molecular weight of the polymer should be chosen so that the polymer is melt processible under the processing conditions. For polylactide, for example, the molecular weight may be from about 10,000 to 300,000 and is preferably from about 30,000 to 200,000. By melt-processible it is meant that the aliphatic polyesters are fluid or pumpable at the temperatures used to process the films and do not significantly degrade or gel at those temperatures. Generally, the Mw of the polymers is above the entanglement molecular weight, as determined by a log-log plot of viscosity versus molecular weight (Mn). Above the entanglement molecular weight, the slope of the plot is about 3.4, whereas the slope of lower molecular weight polymers is 1.

In one embodiment, the microfibers and microfibrillated articles may be prepared from microvoided films using the processes described in U.S. Pat. No. 6,110,588, the entire disclosure of which is incorporated by reference. The disclosed microvoided films are derived from a highly oriented, semicrystalline, melt processed film having a strain induced crystallinity. Strain induced crystallinity is the crystallinity that may be obtained by an optimal combination of subsequent processing such as calendering, annealing, stretching and recrystallization.

Microvoids are microscopic voids in the film, or on the surface of the film, which occur when the film is unable to conform to the deformation process imposed. By "unable to conform" it is meant that the film is unable to sufficiently relax to reduce the stress caused by the imposed strain. The highly oriented highly semicrystalline polymer films are stretched under conditions of plastic flow that exceed the ability of the polymer to conform to the imposed strain, thereby imparting a microvoided morphology thereto. In conventional film orientation processes, such excessive stresses are avoided since they lead to weaknesses in the film and may result in breakage during orientation. During an orientation process step of the present invention there occur small breakages or tears (microvoids) when the deformation stress due to orientation exceeds the Tate of disentangling of the polymer molecules. See, for example, Roger S. Porter and Li-Hui Wang, Journal of Macromolecular Science-Rev. Macromol. Chem. Phys., C35(1), 63–115 (1995).

Microvoids are small defects that occur when the film is drawn at a tension, under conditions of plastic flow, exceeding that at which the film is able to conform to the stress imposed or at a speed that is faster than the relaxation rate of the film (the rate of detanglement of the polymer chains). Microvoids are relatively planar in shape, irregular in size and lack distinct boundaries. Microvoids at the surface of the film are generally transverse to the machine direction (direction of orientation) of the film, while those in the matrix of the film are generally in the plane of the film, or perpendicular to the plane of the film with major axes in the machine direction (direction of orientation). Microvoid size, distribution and amount in the film matrix may be determined by techniques such as small angle x-ray scattering (SAXS), confocal microscopy or density measurement.

Visual inspection of a film may reveal enhanced opacity or a silvery appearance due to significant microvoid content, that can serve as an empirical test of the suitability of an oriented film for the production of a microfibrillated surface. In contrast, film surfaces lacking significant microvoids have a transparent appearance. It has been found that an oriented film lacking in significant amount of microvoids is not readily microfibrillated, even though the film may be split longitudinally, as is characteristic of highly oriented polymer films having a fibrous morphology.

Generally, the greater the microvoid (or void) content, the greater the ease of microfibrillation by the process of this invention. Microfibrillation can be defined as the process of breaking a film down into its microfibrillar components where the microfibers are generally less than 10 microns in average fiber diameter. Preferably, when preparing an article having at least one microfibrillated surface, at least one major surface of the polymer film should have a microvoid content in excess of 5%, preferably in excess of 10%, as measured by density; i.e., the ratio of the density of the microvoided film with that of the starting film. Microvoided films useful in the present invention may be distinguished from other voided films or articles, such as microporous films or foamed articles in that the microvoids are generally non-cellular, relatively planar and have major axes in the machine direction (direction of orientation) of the film. The microvoids do not generally interconnect, but adjacent microvoids may intersect.

Any suitable combination of processing conditions may be used to impart the desired crystallinity and orientation to the melt-processed film. These may include any combination of casting, quenching, annealing, calendering, orienting, solid-state drawing, roll-trusion and the like. The suitability of a film for subsequent process steps may be determined by measuring degree of crystallinity of the polymer film by, for example, x-ray diffraction or by differential scanning calorimetry (DSC). Prefereably the films are cast as substantially amorphous and the crystallinity induced by the strain imposed during the subsequent orientation steps. By "substantially amorphous" it is meant that the degree of crystallinity is 10% or less, preferably 5% or less, as measured by DSC.

In practice, the films first may be subjected to one or more processing steps to impart the desired degree of crystallinity and orientation, and flier processed to impart the microvoids, or the microvoids may be imparted coincident with the process step(s) that impart(s) crystallinity. Thus the same calendering or stretching steps that orient the polymer film and enhance the crystallinity (and orientation) of the polymer may concurrently impart microvoids. Microvoids are imparted by stretching under conditions of plastic flow, that are insufficient to cause catastrophic failure of the film, (i.e., in excess of the ability of the polymer to conform to the strain). Using polylactide, for example, the films may be stretched greater than 6 times its length. In one embodiment the total draw ratio is greater than 6:1 and preferably in the range of 9:1 to about 18:1 for polylactide. "Total draw ratio" is the ratio of the final area of the film to the initial area of the film. If the film is uniaxially oriented, the total draw ratio is the ratio of the final length of the film to the initial length of the film.

Depending on how the film is processed to induce crystallinity and how the film is oriented, one or both surfaces may have significant microvoid content, in addition to significant microvoid content in the bulk of the film. When orienting the film by stretching in the machine direction, microvoids are typically distributed throughout the x, y and z axes of the film, generally following the fibril boundaries, and appearing as microscopic defects or cracks.

The stretching conditions are chosen to impart microvoids (in excess of 5% as measured by the change in density) to the surface of the film. Generally the stretching conditions may be chosen such that, under plastic flow (at a given minimum temperature and maximum stretch ratio), the temperature is reduced about 10° C. or more, or the strain imposed is increased about 10% (stretched about 10%/o further) to induce microvoids. Also, the temperature may be decreased and the stretch ratio increased at the same time, as long as conditions are chosen so as to exceed the ability of the polymer to conform to the strain imposed and avoiding catastrophic failure of the film.

The final thickness of the film will be determined in part by the casting thickness, and the degree of orientation. For most uses, the final thickness of the film prior to microfibrillation will be 1 to 20 mils (0.025 to 0.5 mm), preferably 3 to 10 mils (0.075 to 0.25 mm).

In another embodiment, the microfibers and microfibritlated articles may also be prepared from voided, oriented films having an aliphatic polyester component and a void-initialing component. Such oriented, voided films are described in U.S. Pat. No. 6,331,343 (Perez et al.), the entire disclosure of which is incorporated by reference.

When using the voided, oriented films, the aliphatic polyester component comprises the polymers previously described, including homopolymers, copolymers and blends. The aliphatic polyester component may further comprise small amounts of a second polymer to impart desired properties to the microfibrillated article of the invention. The second polymer of such blends may be semicrystalline or amorphous and is generally less than 30 weight percent, based of the weight of the aliphatic polyester component. For example, small amounts of EVA (ethylene-vinyl acetate) copolymers may be added to polylactide, when used as the aliphatic polyester component, to improve the softness and drapability of the microfibrillated film. Small amounts of other polymers may be added, for example, to enhance stiffness, crack resistance, Elmendorff tear strength, elongation, tensile strength and impact strength, as is known in the art.

The void-initiating component is chosen so as to be immiscible in the semicrystalline polymer component. It may be an organic or an inorganic solid having an average particle size of from about 0.1 to 20 microns, preferably 1 to 10 microns, and may be any shape including amorphous shapes, rhombehedron, spindles, plates, diamonds, cubes, and spheres.

Useful inorganic solids useful as void initiating components include solid or hollow glass, ceramic or metal particles, microspheres or beads; zeolite particles; inorganic compounds including, but not limited to metal oxides such as titanium dioxide, alumina and silicon dioxide; metal, alkali- or alkaline earth carbonates or sulfates; kaolin, talc, carbon black and the like. Inorganic void initiating components are chosen so as to have little surface interaction, due to either chemical nature or physical shapes, when dispersed in the aliphatic polyester component In general the inorganic void initiating components should not be chemically reactive with the polymer component(s), including Lewis acid/base interactions, and have minimal van der Waals interactions.

Preferably the void initiating component comprises a thermoplastic polymer, including semicrystalline polymers and amorphous polymers, to provide a blend immiscible with the aliphatic polyester component. An immiscible blend shows multiple amorphous phases as determined, for example, by the presence of multiple amorphous glass transition temperatures using differential scanning calorimetry or dynamic mechanical analysis. As used herein, "immiscibility" refers to polymer blends with limited solubility and non-zero interfacial tension, i.e. a blend whose free energy of mixing is greater than zero:

$$\Delta G_m 25\ \Delta H_m > 0$$

Miscibility of polymers is determined by both thermodynamic and kinetic considerations. Common miscibility predictors for non-polar polymers are differences in solubility parameters or Flory-Huggins interaction parameters. For polymers with non-specific interactions, such as polyolefins, the Flory-Huggins interaction parameter can be calculated by multiplying the square of the solubility parameter difference with the factor (V/RT), where V is the molar volume of the amorphous phase of the repeated unit, R is the gas constant, and T is the absolute temperature. As a result, the Flory-Huggins interaction parameter between two non-polar polymers is always a positive number.

Polymers useful as the void-initiating component include the above described semicrystalline polymers, as well as amorphous polymers, selected so as to form discrete phases upon cooling from the melt. Useful amorphous polymers include, but are not limited to, polystyrene, polycarbonate, some polyolefins, cyclic olefin copolymers (COC's) such as ethylene norbornene copolymers, and toughening polymers such as styrene/butadiene rubber (SBR) and ethylene/propylene/diene rubber (EPDM).

Specific useful combinations of aliphatic polyester/void initiating component blends include, for example, polylactide and inorganics particles such as $CaCO_3$, and polylactide and polypropylene.

When using an immiscible polymer blend, the relative amounts of the aliphatic polyester component and void initiating polymer component may be chosen so the aliphatic polyester forms a continuous phase and the void initiating polymer component forms a discontinuous phase. As the amount of void initiating polymer in the blend is increased, a composition range will be reached at which the void initiating polymer can no longer be easily identified as the dispersed, or discrete, phase. Further increase in the amount of void initiating polymer in the blend will result in two co-continuous phases, then in a phase inversion wherein the void initiating polymer becomes the continuous phase. Preferably, the aliphatic polyester component forms the continuous phase while the void initiating component forms a discontinuous, or discrete phase, dispersed within the continuous phase of the first polymer. If the void-initiating polymer is semicrystalline and is used in amounts sufficient to form a co-continuous phase, orienting followed by microfibrillation will result is a composite structure of two different microfibers, each derived from the aliphatic polyester and the void-initiating polymer.

In general, as the amount of the void initiating component increases, the amount of voiding in the final film also increases. As a result, properties that are affected by the amount of voiding in the film, such as mechanical properties, density, light transmission, etc., will depend upon the amount of added void initiating component.

Preferably, whether the void initiating component is organic or inorganic, the amount of the void initiating component in the composition is from 1% by weight to 49% by weight, more preferably from 5% by weight to 40% by weight, most preferably from 5% by weight to 25% by weight. In these composition ranges, the first aliphatic polyester forms a continuous phase, while the void initiating component forms the discrete, discontinuous phase.

Additionally, the selected void initiating polymer component must be immiscible with the semicrystalline polymer component selected. In this context, immiscibility means that the discrete phase does not dissolve into the continuous phase in a substantial fashion, i.e., the discrete phase must form separate, identifiable domains within the matrix provided by the continuous phase.

In order to obtain the maximum physical properties and render the polymer film amenable to microfibrillation, the polymer chains need to be oriented along at least one major axis (uniaxial), and less preferably may further be oriented along two major axes (biaxial). This orientation may be effected by a combination of techniques in the present invention, including the steps of calendering and length orienting. In addition to voiding or microvoiding, orientation imparts a fibrillar morphology to the polymer matrix, which is necessary to effect subsequent microfibrillation.

In the present invention, a melt-processed film comprising an aliphatic polyester and void-initiating component is provided. It is preferred that the aliphatic polyester film be substantially amorphous and crystallinity increased by an optimal combination of subsequent processing such as calendering, stretching, recrystallization and annealing following recrystallization. It is believed that maximizing the crystallinity of the film will increase microfibrillation efficiency. Normally, the aliphatic polyester is cast as a substantially amorphous film and then crystallinity increased by strain induced crystallization.

Upon orientation, voids are imparted to the film. As the film is stretched, the two components separate due to the immiscibility of the two components and poor adhesion between the two phases. When the film comprise a continuous phase and a discontinuous phase, the discontinuous phase serves to initiate voids which remain as substantially discrete, discontinuous voids in the matrix of the continuous phase. When two continuous phases are present, the voids that form are substantially continuous throughout the polymer film. Typical voids have major dimensions X and Y, proportional to the degree of orientation in the machine and transverse direction respectively. A minor dimension Z, normal to the plane of the film, remains substantially the same as the cross-sectional dimension of the discrete phase (void initiating component) prior to orientation. Voids arise due to poor stress transfer between the phases of the immiscible blend. It is believed that low molecular attractive forces between the blend components are responsible for immiscible phase behavior; low interfacial tension results in void formation when the films are stressed by orientation or stretching.

The voids are relatively planar in shape, irregular in size and lack distinct boundaries. Voids are generally coplanar with the film, with major axes in the machine (X) and transverse (Y) directions (directions of orientation). The size of the voids is variable and proportional to the size of the discrete phase and degree of orientation. Films having relatively large domains of discrete phase and/or relatively high degrees of orientation will produce relatively large voids. Films having a high proportion of discrete phases will generally produce films having a relatively high void content on orientation. Void size, distribution and amount in the film matrix may be determined by techniques such as small angle x-ray scattering (SAXS), confocal microscopy, scanning electron microscopy (SEM) or density measurement. Additionally, visual inspection of a film may reveal enhanced opacity or a silvery appearance due to significant void content.

As with the microvoided films, the conditions for orientation of the voided films are chosen such that the integrity of the film is maintained. Thus when stretching in the machine and/or transverse directions, the temperature is chosen such that substantial tearing or fragmentation of the continuous phase is avoided and film integrity is maintained. The film is particularly vulnerable to tearing or even catastrophic failure if the temperature is too low, or the orientation ratio(s) is/are excessively high. Preferably, the orientation temperature is above the glass transition temperature of the continuous phase. Such temperature conditions permit maximum orientation in the X and Y directions without loss of film integrity, maximize voiding imparted to the film and consequently maximizing the ease with which the surface(s) may be microfibrillated.

Generally, greater void content enhances the subsequent microfibrillation, and subsequently, using the process of this invention, for uniaxially oriented films, the greater the yield of fibers. Preferably, when preparing an article having at least one microfibrillated surface, the polymer film should have a void content in excess of 5%, more preferably in excess of 10%, as measured by density; i.e., the change in density devided by the initial density; $(\delta_{initial}-\delta_{final})/\delta_{initial}$. Unexpectedly, it has been found that voids may be imparted to the two component (aliphatic polyester and void initiating) polymer films under condition far less severe than those necessary to impart microvoids to microvoided films previously described. It is believed that the immiscible blend, with limited solubility of the two phases and a free energy of mixing greater than zero, facilitates the formation of the voids necessary for subsequent microfibrillation. The voiding is further aided by the lower orientation temperature utilized in the first orientation stage.

As with the microvoided films, the voided films may first be subjected to one or more processing steps to impart the desired degree of crystallinity to the aliphatic polyester component, and further processed to impart the voids, or the voids may be imparted coincident with the process step(s) which impart crystallinity. Thus the same calendering or stretching steps that orient the polymer film and enhance the crystallinity (and orientation) of the polymer may concurrently impart voids.

Whether using microvoided or voided films, the polymer may be extruded from the melt through a die in the form of a film or sheet and quenched to minimize the crystallinity of the aliphatic polyester by maximizing the rate of cooling to form a substantially amorphous film. As the aliphatic polyester phase cools from the melt, it begins to crystallize and spherulites form from the developing crystallites. If cooled rapidly from a temperature above its melting point to a temperature well below the crystallization temperature, a substantially amorphous film is produced. Surprisingly, amorphous films are more readily oriented to produce a microfibrillatable film, in contrast to other semicrystalline polymers such as polypropylene. It is preferred that the films used in the present invention be substantially amorphous, prior to orientation.

If desired, adjuvants may be added to the polymer melt to improve the microfibrillation efficiency, such as silica, calcium carbonate or micaceous materials or to impart a desired property to the microfibers, such as antistats or colorants.

Depending on the thickness of the extruded article, the temperature and the means by which the film is quenched, the morphology of the aliphatic polyester may not be the same across the thickness of the article, i.e., the morphology of the two surfaces and/or the morphology of the surfaces and the matrix may be different. Small differences in morphology do not normally prevent the formation of a microfibrillated surface on either major surface on the film, but if microfibrillated surfaces are desired on both surfaces of the article, it is preferred that casting conditions be carefully controlled to ensure a relatively uniform amorphous morphology across the thickness of the article.

The thickness of the film will be chosen according to the desired end use and can be achieved by control of the process conditions. Cast films will typically have thicknesses of less than 100 mils (2.5 mm), and preferably between 20 and 70 mils (0.8 to 1.8 mm). However, depending on the characteristics desired for the resultant article, they may be cast at thicknesses outside of this range. In the present invention, cast films and well as blown films may be used to produce the microfibrillated films of the invention. Further, the processes described herein can also be advantageously used on films that have been simultaneously biaxially stretched. Such stretching can be accomplished, for example, by the methods and apparatus disclosed in U.S. Pat. No. 4,330,499 (Aufsess et al.) and U.S. Pat. No. 4,595,738 (Hufnagel et al.), and more preferably by the methods and tenter apparatus disclosed in U.S. Pat. No. 4,675,582 (Hommes et al.); U.S. Pat. No. 4,825,111 (Hommes et al.); U.S. Pat. No. 4,853,602 (Hommes et al.); U.S. Pat. No. 5,036,262 (Schonbach); U.S. Pat. No. 5,051,225 (Hommes et al.); and U.S. Pat. No. 5,072,493 (Hommes et al.), the disclosures of which are herein incorporated by reference.

For a film that is to be uniaxially oriented, the cast film may be calendered after quenching. Calendering may allow higher molecular orientation to be achieved by enabling subsequent higher draw ratios. Calendering is generally performed at or above a temperature of 15° C. above the glass transition temperature of the aliphatic polyester, i.e. $T_{calender} \geqq T_g + 15°$ C.

In the orienting step, the film is stretched in the machine direction (X axis) and less preferably, may be simultaneously or sequentially stretched in the transverse direction. The uniaxial stretching induces crystallization and a fibrillar morphology. The oriented fibrils can be visualized as having a rope-like appearance. The stretching conditions are chosen to impart voids or microvoids (in excess of 5% as measured by the change in density) to the film. Subsequent or further orientation of the film in the transverse direction results in reorientation of the fibrils, again in the plane of the film, with varying populations along the X,Y and intermediate axes, depending on the degree of orientation in the machine and transverse directions.

The quenched film may be biaxially oriented by stretching in mutually perpendicular directions at a temperature above the glass transition temperature of the aliphatic polyester phase. Generally, the film is stretched in one direction first and then in a second direction perpendicular to the first. However, stretching may be effected in both directions simultaneously if desired. In a typical process, the film is stretched first in the direction of extrusion over a set of rotating rollers or between two pairs of nip rollers and is then stretched in the direction transverse thereto by means of a tenter apparatus. Films may be stretched in each direction up to 2 to 10 times their original dimension in the direction of stretching.

It is preferred to restrict the stretching in the transverse direction to less than 2×. It has been found that the ability to microfibrillated the films is compromised if the film is oriented in first direction (e.g. in the machine direction) and subsequently oriented in the perpendicular direction more than 2×. It is preferred that the films be oriented uniaxially in a first direction to the desired draw ratio, and then in the perpendicular direction less than 2×. It will be understood however, that in uniaxial orientation, the film may be restrained from shrinking in the lateral direction by means of a tenter apparatus, and such restraint does impose a small degree of biaxial orientation to the film. Such small degrees of biaxial orientation may enhance subsequent microfibrillation.

The temperature of the first orientation (or stretching) affects film properties. Generally, the first orientation step is in the machine direction. Orientation temperature control may be achieved by controlling the temperature of heated rolls or by controlling the addition of radiant energy, e.g., by infrared lamps, as is known in the art. A combination of temperature control methods may be utilized.

Too low of an orientation temperature may result in a film with an uneven appearance. Increasing the first orientation temperature may reduce the uneven stretching, giving the stretched film a more uniform appearance. The first orientation temperature also affects the amount of voiding that occurs during orientation. In the temperature range in which voiding occurs, the lower the orientation temperature, generally the greater the amount of voiding that occurs during orientation. As the first orientation temperature is raised, the degree of voiding decreases to the point of elimination. Electron micrographs of samples show that, at temperatures at which no voiding occurs, the discrete phases domains often deform during stretching. This is in contrast to highly voided oriented samples; electron micrographs of highly voided samples show that the discrete phase domains retain their approximately shape during orientation. A second orientation, in the same direction, or in a direction perpendicular to the first orientation may be desired. The temperature of such second orientation is generally similar to or higher than the temperature of the first orientation.

It is preferred that the film be substantially uniaxially oriented, i.e. oriented to a total draw ratio greater than 6:1, while restricting transverse orientation to less than 2:1. It is further preferred to sequentially, uniaxially orient the film in more than one orientation step to maximize the orientation and concomitantly the crystallinity and voiding (or microvoiding) of the film. Thus the film may be first uniaxially oriented 4× to 6:1, then subsequently oriented 1.5:1 to 3:1, for a total draw ratio of 6:1 to 18:1. It will be understood that the resulting microfibers will have a degree of orientation approximately equal to that of the oriented film. For example, a film subjected to a total draw ratio of 6:1 to 18:1 will yield microfibers having a degree of orientation of about 6:1 to 18:1.

After the film has been stretched it may be further processed. For example, the film may be annealed or heat-set by subjecting the film to a temperature sufficient to further crystallize the aliphatic polyester component while restraining the film against retraction in both directions of stretching.

A general method has been developed for producing a highly voided, highly oriented microfibrillated aliphatic polyester film. The polymer film is formed via typical melt extrusion using a T or "coathanger die" and quenched using a multiple roll take up stack. The temperature of the rolls is maintained around 70° F. such that the extruded film is rapidly quenched and crystallization is minimized, i.e. the film is substantially amorphous. The film or extruded profile is then stretched using a two-stage process. In the first stage, the film is stretched above the glass transition temperature to a sufficient draw ratio at a relatively high strain rate such that the film microvoids but does not fail catastrophically. The film may be stretched by a variety of methods including but not limited to roll drawing (calendering), length orienting using hot rolls, zone drawing, or hot drawing in a liquid media. Length orienting has been used extensively in traditional film processing often in the first step of a sequential biaxial orientation process. The onset of microvoiding can be visually observed as the transparent film becomes opaque. If a voiding agent is used, extensive voiding can be realized as the particle de-bonds from the aliphatic polyester. Typically, a draw ratio of 4:1–6:1 can be achieved in the first stage dependent on the polymer that is used.

The second stage stretching process is performed at a higher draw temperature below the melting point of the polymer than the temperature of the first stage. Generally the temperature of the second stage is at least 20° C. higher than that of the first stage. In this stage, the film is further drawn to a high ratio and a microfibrillar structure is observed. The increase in molecular orientation can be measured using X-ray scattering and changes in crystallinity by DSC. Usually in the second stage, the crystallinity increases significantly due to the higher orientation and temperature imposed in the process. The preferred method of stretching is length orientation using hot rolls running at different speeds. The final voided or microvoided film has a silvery appearance and can be easily split in the direction of the drawing (machine direction). Additional drawing stages allow the film to be further oriented but are not necessary.

The final thickness of the film will be determined in part by the casting thickness, the degree of orientation, and any additional processing such as calendering. For most uses, the final thickness of the film prior to microfibrillation will be 1 to 20 mils (0.025 to 0.5 mm), preferably 3 to 10 mils (0.075 to 0.25 mm). If desired, multilayer films comprising at least one layer of aliphatic polyester may be used.

The voided or microvoided aliphatic polyester film is then microfibrillated by imparting sufficient fluid energy to the surface to release the microfibers from the polymer matrix. In a microfibrillation process, relatively greater amounts of energy are imparted to the film surface to release microfibers, relative to that of a conventional mechanical fibrillation process. Microfibers are several orders of magnitude smaller in diameter than the fibers obtained by mechanical means (such as with a porcupine roller) ranging in size from less than 0.01 microns to 20 microns. The microfibers obtained from uniaxially oriented films are rectangular in cross section, having a cross sectional aspect ratio (transverse width to thickness) ranging from of about 1.5:1 to about 30:1. Further, the sides of the rectangular shaped microfibers (prepared from uniaxially oriented films) are not smooth, but have a scalloped appearance in cross section. Scanning electron microscopy reveals that the microfibers of the present invention are bundles of individual or unitary microfibrils, which in aggregate form the rectangular or ribbon-shaped microfibers. Thus the surface area exceeds that which may be expected from rectangular shaped microfibers, and such surface enhances bonding in matrices such as concrete and thermoset plastics, as well as provide greater surface area for enhanced biodegradability, where desired.

Optionally, prior to microfibrillation, the film may be subjected to a macrofibrillation step by conventional mechanical means to produce macroscopic fibers from the highly oriented film. The conventional means of mechanical fibrillation uses a rotating drum or roller having cutting elements such as needles or teeth in contact with the moving film. The teeth may fully or partially penetrate the surface of the film to impart a macrofibrillated surface thereto. Other similar macrofibrillating treatments are known and include such mechanical actions as twisting, brushing (as with a porcupine roller), rubbing, for example with leather pads, and flexing. The fibers obtained by such conventional macrofibrillation processes are macroscopic in size, generally several hundreds of microns in cross section. Such macroscopic fibers are useful in a myriad of products such as particulate filters, as oil absorbing media, and as electrets.

One method of microfibrillating the surface of the film is by means of fluid jets. In this process one or more jets of a fine fluid stream impact the surface of the aliphatic polyester film, which may be supported by a screen or moving belt, thereby releasing the microfibers from the polymer matrix. One or both surfaces of the film may be microfibrillated. The degree of microfibrillation is dependent on the exposure time of the film to the fluid jet, the pressure of the fluid jet, the cross-sectional area of the fluid jet, the fluid contact angle, the polymer properties and, to a lesser extent, the fluid temperature. Different types and sizes of screens can be used to support the film.

Any type of liquid or gaseous fluid may be used. Liquid fluids may include water or organic solvents such as ethanol or methanol. Suitable gases such as nitrogen, air or carbon dioxide may be used, as well as mixtures of liquids and gases. Any such fluid is preferably non-swelling (i.e., is not absorbed by the polymer matrix), which would reduce the orientation and degree of crystallinity of the microfibers. For imparting a charge during micro fibrillation, the preferred fluid is water and is most preferably deionized or distilled water substantially free of any contaminants such as salts or minerals that could dissipate the electrostatic charge. The fluid temperature may be elevated, although suitable results may be obtained using ambient temperature fluids. The pressure of the fluid should be sufficient to impart some degree of microfibrillation to at least a portion of the film, and suitable conditions can vary widely depending on the fluid, the nature of the polymer, including the composition and morphology, configuration of the fluid jet, angle of impact and temperature. Generally, less severe conditions are needed to microfibrillated the voided films and voided foams when compared to the microvoided films.

Typically, the fluid is water at room temperature and at pressures of greater than 6800 kPa (1000 psi), preferably greater than 10,300 kPa (1500 psi) although lower pressure and longer exposure times may be used. Such fluid will generally impart a minimum of 10 watts or 20 W/cm$^2$ based on calculations assuming incompressibility of the fluid, a smooth surface and no losses due to friction.

The configuration of the fluid jets, i.e., the cross-sectional shape, may be nominally round, but other shapes may be employed as well. The jet or jets may comprise a slot which traverses a section or which traverses the width of the film. The jet(s) may be stationary, while the film is conveyed relative to the jet(s), the jet(s) may move relative to a stationary film, or both the film and jet may move relative to each other. For example, the film may be conveyed in the machine (longitudinal) direction by means of feed rollers while the jets move transverse to the web. Preferably, a plurality of jets is employed, while the film is conveyed through the microfibrillation chamber by means of rollers, while the film is supported by a screen or scrim, which allows the fluid to drain from the microfibrillated surface. The film may be microfibrillated in a single pass, or alternatively the film may be microfibrillated using multiple passes past the jets.

The jet(s) may be configured such that all or part of the film surface is microfibrillated. Alternatively, the jets may be configured so that only selected areas of the film are microfibrillated. Certain areas of the film may also be masked, using conventional masking agents to leave selected areas free from microfibrillation. Likewise the process may be conducted so that the microfibrillated surface penetrates only partially, or fully through the thickness of the starting film. If it is desired that the microfibrillated surface extend through the thickness of the film, conditions may be selected so that the integrity of the article is maintained and the film is not severed into individual yams or fibers. A screen or mesh may be used to impart a pattern to the surface of the microfibrillated article.

A hydroentangling machine, for example, can be employed to microfibrillate one or both surfaces by exposing the fibrous material to the fluid jets. Hydroentangling machines are generally used to enhance the bulkiness of microfibers or yarns by using high-velocity water jets to wrap or knot individual microfibers in a web bonding process, also referred to as jet lacing or spunlacing. Alternatively a pressure water jet, with a swirling or oscillating head, may be used, which allows manual control of the impingement of the fluid jet.

With the use of fluid jets, the degree of microfibrillation can be controlled to provide a low degree or high degree of microfibrillation. A low degree of microfibrillation may be desired to enhance the surface area by partially exposing a minimum amount of microfibers at the surface and thereby imparting a fibrous texture to the surface of the film. The enhanced surface area consequently enhances the bondability of the surface. Such articles are useful, for example as substrates for abrasive coatings and as receptive surfaces for printing, as hook and loop fasteners, as interlayer adhesives and as tape backings. Conversely, a high degree of microfibrillation may be required to impart a highly fibrous texture to the surface to provide cloth-like films, insulating articles, filter articles or to provide for the subsequent harvesting of individual microfibers (i.e., removal of the microfibers) from the polymer matrix.

In another embodiment, the microfibrillation may be conducted by immersing the sample in a high energy cavitating medium. One method of achieving this cavitation is by applying ultrasonic waves to the fluid. The rate of microfibrillation is dependent on the cavitation intensity. Ultrasonic systems can range from low acoustic amplitude, low energy ultrasonic cleaner baths, to focused low amplitude systems up to high amplitude, high intensity acoustic probe systems.

One method, which comprises the application of ultrasonic energy, involves using a probe system in a liquid medium in which the fibrous film is immersed. The horn (probe) should be at least partially immersed in the liquid. For a probe system, the fibrous film is exposed to ultrasonic vibration by positioning it between the oscillating horn and a perforated metal or screen mesh (other methods of positioning are also possible), in the medium. Advantageously, both major surfaces of the film are microfibrillated when using ultrasound. The depth of microfibrillation in the fibrous material is dependent on the intensity of cavitation, amount of time that it spends in the cavitating medium and the properties of the fibrous material. The intensity of cavitation is a factor of many variables such as the applied amplitude and frequency of vibration, the liquid properties, fluid temperature and applied pressure and location in the cavitating medium. The intensity (power per unit area) is typically highest beneath the horn, but this may be affected by focusing of the sonic waves.

The method comprises positioning the film between the ultrasonic horn and a film support in a cavitation medium (typically water) held in a tank. The support serves to restrain the film from moving away from the horn due to the extreme cavitation that takes place in this region. The film can be supported by various means, such as a screen mesh, a rotating device that may be perforated or by adjustment of tensioning rollers which feed the film to the ultrasonic bath. Film tension against the horn can be alternatively used, but correct positioning provides better fibrillation efficiency. The distance between the opposing faces of the film and the horn and the screen is generally less than about 5 mm (0.2 inches). The distance from the film to the bottom of the tank can be adjusted to create a standing wave that can maximize cavitation power on the film, or alternatively other focusing techniques can be used. Other horn to film distances can also be used. The best results typically occur when the film is positioned near the horn or at ¼ wavelength distances from the horn, however this is dependent factors such as the shape of the fluid container and radiating surface used. Generally positioning the sample near the horn, or the first or second ¼ wavelength distance is preferred.

The ultrasonic pressure amplitude can be represented as:

$$P_0=2\pi B/\lambda=(2\pi/\lambda)\rho c^2 y_{max}$$

The intensity can be represented as:

$$I=(P_0)^2/2\rho c$$

where $P_0$=maximum (peak) acoustic pressure amplitude

I=acoustic intensity

B=bulk modulus of the medium $\lambda$=wavelength in the medium $y_{max}$=peak acoustic amplitude $\rho$=density of the medium, and c=speed of the wave in the medium Ultrasonic cleaner bath systems typically can range from 1 to 10 watt/cm$^2$ while horn (probe) systems can reach 300 to 1000 watt/cm$^2$ or more. Generally, the power density levels (power per unit area, or intensity) for these systems may be determined by the power delivered divided by the surface area of the radiating surface. However, the actual intensity may be somewhat lower due to wave attenuation in the fluid. Conditions are chosen so as to provide acoustic cavitation. In general, higher amplitudes and/or applied pressures provide more cavitation in the medium. Generally, the higher the cavitation intensity, the faster the rate of microfiber production and the finer (smaller diameter) the microfibers that are produced. While not wishing to be bound by theory, it is believed that high pressure shock waves are produced by the collapse of the incipient cavitation bubbles, which impacts the film resulting in microfibrillation.

The ultrasonic oscillation frequency is usually 20 to 500 kHz, preferably 20–200 kHz and more preferably 20–100 kHz. However, sonic frequencies can also be utilized without departing from the scope of this invention. The power density (power per unit area, or intensity) can range from 1 W/cm$^2$ to 1 kW/cm$^2$ or higher. In the present process it is preferred that the power density be 10 watt/cm$^2$ or more, and preferably 50 watt/cm$^2$ or more.

The gap between the film and the horn can be, but it is not limited to, 0.001 to 3.0 inches (0.03 to 76 mm), preferably 0.005 to 0.05 inches (0.13 to 1.3 mm). The temperature can range from 5 to 150° C., preferably 10 to 100° C., and more preferably from 20 to 60° C. A surfactant or other additive can be added to the cavitation medium or incorporated within the fibrous film. The treatment time depends on the initial morphology of the sample, film thickness and the cavitation intensity. This time can range from 1 millisecond to one hour, preferably from 1/10 of a second to 15 minutes and most preferably from ½ second to 5 minutes.

In either microfibrillation process most of the microfibers stay attached to the web due to incomplete release from the polymer matrix. Advantageously the microfibrillated article, having secured to a web, provides a convenient and safe means of handling, storing and transporting the microfibers. For many applications it is desirable to retain the microfibers secured to the web. Further, the integral microfibers may be extremely useful in many filtering applications-the present microfibrillated article provides a large filtering surface area due to the microscopic size of the microfibers while the non-fibrillated surface of the film may serve as an integral support.

Further, in either microfibrillation process, the degree or depth of microfibrillation can be controlled. Microfibrillated articles may be prepared in which the depth of microfibrillation (i.e. the thickness of the microfibrillated layer) is as little as 10 microns, but may be 50 microns or greater, 100 microns or greater, up to the thickness of a completely microfibrillated film.

Optionally the microfibers may be harvested from the surface of the film by mechanical means such as with a porcupine roll, scraping and the like. Harvested microfibers generally retain their bulkiness (loft) due to the high modulus of the individual microfibers and, as such, are useful in many thermal insulation applications such as clothing. If necessary, loft may be improved by conventional means, such as those used to enhance the loft of blown microfibers, for example by the addition of staple fibers.

The present invention also provides a multilayer article comprising at least one microfibrillated layer and at least one additional layer, which may be porous or non-porous. In such a multilayer construction, the microfibrillated film layer may be an exterior layer or an interior layer. The additional layers of a multilayer article may include non-woven fabrics scrims or webs, woven fabrics or scrims, porous film, and non-porous film. Such materials may be bonded or laminated to the film of the invention by, for example, pressing the film and the web together in a nip between a smooth roll and a second roll (preferably having an embossing pattern on its surface) and heated sufficiently to soften the material facing the metal roll. Other bonding means such as are known in the art may also be used. Alternatively materials may be laminated by means of adhesives such as pressure-sensitive or hot-melt adhesives.

Surprisingly, in such multilayer constructions, it is not necessary to contact the aliphatic polyester film layer in order to effect fibrillation. When bonded to an additional film or scrim layer, the high pressure fluid may also effect fibrillation by impinging on the additional film layer.

Multilayer films comprising at least one fibrillated film layer of the invention may be prepared using a variety of equipment and a number of melt-processing techniques (typically, extrusion techniques) well known in the art. Such equipment and techniques are disclosed, for example, in U.S. Pat No. 3,565,985 (Schrenk et al.), U.S. Pat No. 5,427,842 (Bland et al.), U.S. Pat No. 5,589,122 (Leonard et al.), U.S. Pat No. 5,599,602 (Leonard et al.), and U.S. Pat No. 5,660,922 (Herridge et al.). For example, single- or multi-manifold dies, full moon feedblocks (such as those described in U.S. Pat. No. 5,389,324 to Lewis et al.), or other types of melt processing equipment can be used, depending on the number of layers desired and the types of materials extruded.

For example, one technique for manufacturing multilayer films of the present invention can use a coextrusion technique, such as that described in U.S. Pat No. 5,660,922 (Herridge et al.). In a coextrusion technique, various molten streams are transported to an extrusion die outlet and joined together in proximity of the outlet. Extruders are in effect the "pumps" for delivery of the molten streams to the extrusion die. The particular extruder is generally not critical to the process. A number of useful extruders are known and include single and twin screw extruders, batch-off extruders, and the like. Conventional extruders are commercially available from a variety of vendors such as Davis-Standard Extruders, Inc. (Pawcatuck, Conn.), Black Clawson Co. (Fulton, N.Y.), Berstorff Corp. (KY), Farrel Corp. (CT), and Moriyama Mfr. Works, Ltd. (Osaka, Japan).

The present invention provides microfibers with a very small effective average diameter (average width and thickness), generally less than 10 pun) from aliphatic polyester materials. The small diameter of the microfibers provides advantages in many applications where efficiency or performance is improved by small fiber diameter. For example, the surface area of the microfibers (or the microfibrillated film) is inversely proportional to fiber diameter allowing for the preparation of more efficient filters. The high surface area also enhances the performance when used as adsorbents, such as in oil-absorbent mats or batts used in the clean up of oil spills and slicks. Such performance advantages are enhanced when using charged microfibers, fibers and microfibrillated articles of the present invention.

The present invention provides a wipe comprising the of the present invention. The article may comprise a microfibrillated article (i.e. a film having a microfibrillated surface). The microfibrillated article is particularly useful, because they are integral to the film.

The wipe (or wiping article) may also be prepared from the microfibers harvested from the microfibrillated article. Such fibers may be used for example, in a non-woven construction using techniques known to the art. Such a non-woven construction may further include stable fibers.

The wipe may further comprise a support. In dusting applications, for example, it is desirable to provide a wiping article that has at least one portion capable of picking up finer dust particles and at least one portion providing a means for grasping or holding the article and preferably also providing a second cleaning function such as picking up larger dirt particles, for example. Most preferably, it is desirable to provide an article capable of performing the foregoing cleaning applications without added chemicals. It is desirable to provide such a cleaning article in a variety of forms suited to particular cleaning applications such as dusting and wiping applications as well as personal care applications and the like.

The support may be formed from any of a variety of materials capable of supporting the cloth layer and providing a means to grasp the article during a cleaning application (e.g., dusting). Included as possible support materials are lofty, three dimensional, nonwoven webs, foamed polymers such as foamed polyurethane, sponges and the like. In cleaning applications, the microfiber layer (i.e. the layer comprising microfibers) and the support can perform separate cleaning functions. The wipe can therefore comprise a microfibrous surface and a support layer bonded or otherwise affixed thereto.

When used as a filtration media, the microfibrillated article may be used in complex shapes, such as pleats. Pleated structures may be prepared by standard pleating methods and equipment. The filtration media may be used alone or may be laminated to further functional layers by adhesives, heat bonding, ultrasonics and the like. The further functional layers can be prefilter layers for large diameter particles, support layers such as scrims, spunbond, spunlace, melt blown, air-laid nonwoven, wet laid nonwoven, or glass fiber webs, netting such as Delnet, metal mesh or the like; absorbent filter media, or protective cover layers. Multiple layers of the filter media may be laminated together to provide improved performance.

The fibrous electret filter produced by the method of the present invention is especially useful as an air filter element of a respirator such as face mask or for such purposes as home and industrial air-conditioners, air cleaners, vacuum cleaners, medical air line filters, and air conditioning systems for vehicles and common equipment such as computers, computer disk drives and electronic equipment. In respirator uses, the charged filters may be in the form of molded or folded half-face mask, replaceable cartridges or canisters, or prefilters. In such uses, an air filter element produced by the method of invention is surprisingly effective for removing particulate aerosols.

If desired, the microfibrillated article (including the filter media and wipes) may have a pattern embossed on the surface thereof. The embossed pattern may be merely decorative, or may provide structural integrity to the article. The surface may be embossed to a degree to improve the handleability, or integrity, but not substantially interfere with the ability to gather dust (for wipes) or filtration performance. The embossments may be continuous, define individual, separated geometric shapes such as squares or circles, or may be a pattern of discontinuous straight or curved lines. Generally, the degree of embossing is less than 40% of the working area of the article, and preferably less than 10%.

Any of a wide variety of embossing methods known to the art may be used to provide the embossments. For example, conventional heat and pressure may be used. Other useful methods include impulse sealing with pressure in which the web is rapidly heated and cooled under pressure, thereby minimizing any undesirable heat transfer, ultrasonic welding with pressure, rotary pressure embossing under ambient conditions, i.e. without heating. It is desirable to minimize heat transfer to avoid charge degradation.

The microfibrillated articles of the invention are also useful as geotextiles, such as those used for stabilization, protection or drainage of soils. The article may be used with foundation, soil, rock, earth or any other geotechnical engineering material as an integral part of a manmade project, structure or system. Microfibrillated article may be used in separation, stabilization, reinforcement, filtration and drainage applications. In filtration applications, a microfibrillated article traps particles of soil while allowing water to pass through. It is particularly useful in applications where biodegradability is desired, such as in the temporary stabilization of soils, where the microfibrillated article would degrade as plant cover grew. In such geotextile applications, the microfibrillated article may be fully- or partially microfibrillated, depending on whether permeability of the geotextile is desired.

EXAMPLES

All examples were prepared using the same starting initial film that was cold cast using a two-roll stack at 84° F. (29°

C.). Medical grade commercially available poly(L-Lactide) was purchased from Boehringer Ingelheim (Resomer L210S). The polymer was cast into a 20 mil (508 micrometer) film compounded with 16 wt % calcium carbonate (Hipflex 100 available from Specialty Minerals, Inc. Adams, Mass.) using a twin screw extruder at a screw RPM of 160. The following temperature zones were used.

Feed: 100° F. (38° C.)

Heating: 340° F. (171° C.)

Barrel: 390° F. (199° C.)

Die: 390° F. (199° C.)

All drawing stages were conducted on a laboratory scale length orienter (LO) device that consisted of two preheat rolls, a slow drive roll, and a fast drive roll. A film is oriented between the two drive rolls in a uniaxial fashion by having the fast or second drive roll rotate at a speed higher compared to the first or slow drive roll. Both of the aluminum drive rolls were electrically heated and were nipped using nitrite rubber coated steel rolls. All draw temperatures reported refer to the slow drive roll temperature unless otherwise specified.

Example 1

The polylactide film was stretched to a draw ratio of 4.5 at 183° F. (84° C.) and stretched in second stage to a total draw ratio of 8.5 at a roll temperature of 261° F. (127° C.). Prior to microfibrillation, the highly oriented film could be split uniaxially by hand. The film was passed 3 times per side at 10 ft/min (3.05 m/min) using a single head hydroentangler (51 holes per inch, 110 micron hole size) at an operating pressure of 1700 psi (11.7 MPa) resulting in a nowoven tape with a plurality of microfibers.

Example 2

The polylactide film was drawn to a draw ratio of 4 at 180° F. (82° C.) followed by a second stage draw to a total draw ratio of 8 at 264° F. (129° C.). The resulting microfibrillar film was processed as in Example 1 except an operating (water) pressure of 1800 psi (12.4 MPa) was used along with a very coarse stainless steel support under the water jets. The final microfibrillated article had a tufted three-dimensional surface.

Example 3

A microfibrillated film was prepared by using a two-stage drawing process as described previously (first draw ratio of 5 at 183° F. (84° C.)) with a total draw ratio of 8.5 (second stage draw temperature of 274° F. (134.4° C.)). The material was microfibrillated as in Example 1 using 4 passes per side at 1600 psi (11.0 MPa) resulting in a soft microfibrillated article have two microfibrillated surfaces.

What is claimed is:

1. A microfibrillated article comprising an oriented aliphatic polyester film having a microfibrillated surface comprising microfibers of average effective diameter of 10 micrometers or less, a transverse aspect ratio of from 1.5:1 to 20:1 and a cross-sectional area of 0.05 $\mu^2$ to 3.0 $\mu^2$.

2. The microfibrillated article of claim 1, wherein said microfibers have a cross-sectional area of 0.1 $\mu^2$ to 2.0 $\mu^2$.

3. The microfibrillated article of claim 1, wherein said microfibers have a surface area of at least 0.25 $m^2$/gram.

4. The microfibrillated article of claim 1, wherein said microfibers comprise bundles of unitary microfibrils.

5. The microfibrillated article of claim 1 wherein said aliphatic polyester comprises a homo- and copolymers of poly(hydroxyalkanoate).

6. The microfibrillated article of claim 1 wherein said aliphatic polyester is derived from the reaction product of one or more alkanediols with one or more alkanedicarboxylic acids.

7. The microfibrillated article of claim 1 wherein said aliphatic polyester is selected from polybutylenesuccinate homopolymer, polybutylene adipate homopolmer, polybutyleneadipate-succinate copolymer polyethylenesuccinate-adipate copolymer, and polyethylene adipate homopolymer.

8. The microfibrillated article of claim 5 wherein said poly(hydroxyalkanoate) is selected from the group consisting of polylactide, polydioxanone, polycaprolactone, poly (3-hydroxybutyrate) poly(3-hydroxyvalerate), polyglycolide and poly(oxyethylene glycolate).

9. The microfibrillated article of claim 1, wherein said microfibers comprise a blend of two or more aliphatic polyesters.

10. The microfibrillated article of claim 1, wherein said microfibers are bioabsorbable.

11. The microfibrillated article of claim 1, wherein said microfibers are biodegradable.

12. The microfibrillated article of claim 1, wherein said microfibrillated article comprises a film having at least one microfibrillated surface.

13. The microfibrillated article of claim 1, wherein said microfibrillated article comprises a film having two microfibrillated surfaces.

14. The microfibrillated article of claim 1, wherein said microfibrillated article comprises a film having a microfibrillated morphology through the thickness of the film.

15. The microfibrillated article of claim 1 having a depth of microfibrillation of 10 microns or greater.

16. A process for preparing the microfibrillated article of claim 1 comprising the steps of:

(a) providing an aliphatic polyester film;

(b) stretching said film to impart a microvoided and microfibrillar morphology thereto; and (c) microfibrillating said film by imparting sufficient fluid energy thereto.

17. The process of claim 16 wherein fluid energy is imparted with a high-pressure fluid.

18. The process of claim 16 wherein said step of microfibrillating comprises subjecting said film to cavitation energy while immersed in a fluid.

19. The process of claim 16 wherein said step of microfibrillating comprises contacting the film with one or more high-pressure fluid jets.

20. The process of claim 16 wherein said highly oriented polymer film is prepared by the steps of (a) extruding a melt-processible aliphatic polyester;

(b) casting said polyester so as form a substantially amorphous film.

21. The process of claim 16 wherein said stretching imposes a stress on said film, wherein said stretching is performed under conditions of plastic flow exceeding the ability of said film to conform to said imposed strain.

22. The process of claim 16 wherein said polymer is stretched at a total draw ratio of greater than 6:1 to produce a highly oriented film having a plurality of microvoids.

23. The process of claim 16 wherein said aliphatic polyester film comprises void-initiating particles dispersed in the film.

24. The process of claim 16 wherein said film is oriented to a total draw ratio of greater than 6:1.

25. The process of claim 16 wherein said film is length oriented greater than 6:1 and transversely oriented less than 2:1.

* * * * *

UNITED STATES PATENT AND TRADEMARK OFFICE

CERTIFICATE OF CORRECTION

PATENT NO. : 6,890,649 B2
APPLICATION NO. : 10/647525
DATED : May 10, 2005
INVENTOR(S) : Terry R. Hobbs et al.

It is certified that error appears in the above-identified patent and that said Letters Patent is hereby corrected as shown below:

On the Title Page, in Col. 1, item 56 under (Related U.S. Application)
Lines 1-2, after "Division of" delete "application No. 10/132,964, filed on Apr. 26, 2002, now".

On the Title Page, in Col. 2, item 56 under (Other Publications)
Line 1, delete "fo" and insert -- of --, therefor.

On Page 2 of the Title Pages, Col. 2, item (56) under (Other Publications)
Line 2, delete "," and insert -- . --, therefor.
Line 24, delete "ppl" and insert -- pp. --, therefor.

Col. 1
Lines 5-6, after "divisional of" delete "application Ser. No. 10/132,964 filed on Apr. 26, 2002 now".
Line 41, insert -- the -- before "high".

Col. 3
Line 28, delete "Or" and insert -- or --, therefor.
Line 37, delete ">" and insert -- ≥ --, therefor.

Col. 4
Line 11, delete "poly(4-hydropcntanoate)" and insert -- poly(4-hydropentanoate) --, therefor.

Col. 6
Line 54, delete "Tate" and insert -- rate --, therefor.

Col. 7
Line 49, delete "flier" and insert -- further --, therefor.

Col. 8
Line 13, delete "10%/0" and insert -- 10% --, therefore.
Lines 24-25, delete "microfibritlated" and insert -- microfibrillated --, therefor.
Line 27, delete "initialing" and insert -- initiating --, therefor.
Line 63, after "component" insert -- . --.

Col. 9

Line 12, delete "$\Delta G_m 25\ \Delta H_m > 0$" and insert -- $\Delta G_m \cong \Delta H_m > 0$ --, therefor.

UNITED STATES PATENT AND TRADEMARK OFFICE

CERTIFICATE OF CORRECTION

PATENT NO. : 6,890,649 B2
APPLICATION NO. : 10/647525
DATED : May 10, 2005
INVENTOR(S) : Terry R. Hobbs et al.

It is certified that error appears in the above-identified patent and that said Letters Patent is hereby corrected as shown below:

Col. 16
Line 14, delete “yams” and insert -- yarns --, therefor.

Col. 19
Line 22, delete “pun” and insert -- μm --, therefor.

Col. 21
Line 19, delete “nitrite” and insert -- nitrile --, therefor.

Col. 22
Line 4, after “copolymer” insert -- , --.
Line 10, after “(3-hydroxybutyrate)” insert -- , --.

Signed and Sealed this

Thirteenth Day of November, 2007

JON W. DUDAS
*Director of the United States Patent and Trademark Office*